US010224166B2

(12) United States Patent
Schlaak et al.

(10) Patent No.: US 10,224,166 B2
(45) Date of Patent: Mar. 5, 2019

(54) HIGH-CURRENT FUSE WITH ENDBELL ASSEMBLY

(71) Applicant: LITTELFUSE, INC., Chicago, IL (US)

(72) Inventors: Michael Schlaak, Chicago, IL (US); Gregory Stumpo, Chicago, IL (US); Ken Venhaus, Chicago, IL (US); Derek Lasini, Chicago, IL (US)

(73) Assignee: LITTELFUSE, INC., Chicago, IL (US)

( * ) Notice: Subject to any disclaimer, the term of this patent is extended or adjusted under 35 U.S.C. 154(b) by 0 days.

(21) Appl. No.: 15/164,255

(22) Filed: May 25, 2016

(65) Prior Publication Data

US 2016/0268089 A1 Sep. 15, 2016

Related U.S. Application Data

(63) Continuation-in-part of application No. 14/699,407, filed on Apr. 29, 2015, now Pat. No. 9,761,402.
(Continued)

(51) Int. Cl.
*H01H 85/175* (2006.01)
*H01H 85/042* (2006.01)
(Continued)

(52) U.S. Cl.
CPC ..... *H01H 85/042* (2013.01); *H01H 69/02* (2013.01); *H01H 85/147* (2013.01);
(Continued)

(58) Field of Classification Search
CPC .. H01H 85/185; H01H 85/042; H01H 85/175; H01H 69/02; H01H 85/08; H01H 85/10; H01H 85/18
(Continued)

(56) References Cited

U.S. PATENT DOCUMENTS 1,217,289 A 2/1917 Eustice
1,463,038 A 7/1923 Ellison
(Continued)

FOREIGN PATENT DOCUMENTS

CN 1371114 A 9/2002
CN 202285226 U 6/2012
KR 20130121637 A 11/2013

OTHER PUBLICATIONS

European Search Report for European Patent Application No. 15859086, dated May 18, 2018, 2 pages.

*Primary Examiner* — Anatoly Vortman

(57) ABSTRACT

A fuse including a fuse body defining an inner cavity and having at least one fuse body aperture formed therethrough, a fuse element including a first terminal and a second terminal, a first endbell and a second endbell coupled to the fuse element, the first endbell having at least two grooves formed in a surface thereof and having a first O-ring seal disposed in at least one of the grooves, the second endbell having at least two grooves formed in a surface thereof and having a second O-ring seal disposed in at least one of the grooves, an adhesive securing the first and second endbells to the fuse body, an arc quenching material disposed within the inner cavity and contacting at least a portion of the fuse element, and end caps coupled to the fuse body, the end caps sealing a portion of the fuse element within the fuse body.

12 Claims, 8 Drawing Sheets

Related U.S. Application Data

(60) Provisional application No. 62/079,714, filed on Nov. 14, 2014.

(51) Int. Cl.

| | |
|---|---|
| ***H01H 69/02*** | (2006.01) |
| ***H01H 85/18*** | (2006.01) |
| ***H01H 85/08*** | (2006.01) |
| ***H01H 85/10*** | (2006.01) |
| ***H01H 85/38*** | (2006.01) |
| ***H01H 85/147*** | (2006.01) |
| ***H01H 85/17*** | (2006.01) |

(52) U.S. Cl.
CPC ..... *H01H 85/17* (2013.01); *H01H 85/175* (2013.01); *H01H 85/185* (2013.01); *H01H 85/38* (2013.01); *H01H 85/08* (2013.01); *H01H 85/10* (2013.01); *H01H 85/18* (2013.01)

(58) Field of Classification Search
USPC ..... 337/228, 231, 248
See application file for complete search history.

(56) References Cited

U.S. PATENT DOCUMENTS

| | | | | | |
|---|---|---|---|---|---|
| 1,559,890 | A | * | 11/1925 | La Mar | H01H 85/153 337/248 |
| 2,665,348 | A | | 1/1954 | Kozacka | |
| 2,837,614 | A | * | 6/1958 | Fister | H01H 85/003 337/139 |
| 3,250,879 | A | * | 5/1966 | Jacobs, Jr. | H01H 85/003 337/248 |
| 3,538,479 | A | * | 11/1970 | Fister | H01H 85/0456 337/161 |
| 3,630,219 | A | | 12/1971 | Kozacka | |
| 4,003,129 | A | * | 1/1977 | Koch | H01H 69/02 29/614 |
| 4,032,879 | A | | 6/1977 | Monagan | |
| 4,044,326 | A | * | 8/1977 | Rodrigues | H01H 69/02 337/248 |
| 4,109,228 | A | | 8/1978 | Wycklendt et al. | |
| 4,254,394 | A | | 3/1981 | Kozacka et al. | |
| 4,274,073 | A | | 6/1981 | Luck et al. | |
| 4,336,521 | A | | 6/1982 | Kozacka et al. | |
| 4,684,915 | A | | 8/1987 | Knapp, Jr. | |
| 4,935,716 | A | | 6/1990 | Ehlmann | |
| 5,077,534 | A | | 12/1991 | Douglass | |
| 5,245,308 | A | | 9/1993 | Herbias | |
| 5,296,832 | A | | 3/1994 | Perreault et al. | |
| 5,426,411 | A | | 6/1995 | Pimpis et al. | |
| 5,963,123 | A | | 10/1999 | Douglass | |
| 5,994,994 | A | | 11/1999 | Ito et al. | |
| 6,888,440 | B2 | | 5/2005 | Ackermann | |
| 7,369,030 | B2 | * | 5/2008 | Darr | H01H 85/30 324/550 |
| 7,659,804 | B2 | | 2/2010 | Harris et al. | |
| 2006/0049911 | A1 | | 3/2006 | Darr | |

* cited by examiner

HIGH-CURRENT FUSE WITH ENDBELL ASSEMBLY

CROSS-REFERENCE TO RELATED APPLICATIONS

This application is a Continuation-in-part application of pending U.S. patent application Ser. No. 14/699,407, filed Apr. 29, 2015, which claims the benefit of U.S. Provisional Patent Application Ser. No. 62/079,714, filed Nov. 14, 2014, entitled "Improved High-Current HEV Fuse with Endbell Assembly," the entireties of which applications are incorporated by reference herein.

FIELD OF THE DISCLOSURE

This disclosure relates generally to circuit protection devices and more particularly to high-current fuses.

BACKGROUND OF THE DISCLOSURE

Fuses are commonly used as circuit protection devices. Fuses can provide electrical connections between sources of electrical power and circuit components to be protected. High-voltage, current-limiting fuses are used in a variety of applications including, for example, the development of Hybrid-Electric Vehicles (HEVs). HEV systems typically use much higher voltages and currents than non-HEV automotive systems. Bus voltages for HEV systems can be in the range of 600 volts DC or AC and currents can be in the range of 300 amps. High-voltage applications, such as HEV systems, therefore use a fuse capable of handling the increased energy and arcing associated with an opening of a fuse element within the fuse used for such applications.

Known HEV fuses and known high-voltage fuses in general may contain sand within the fuse body and may fail to provide consistent results when filling a fuse with sand. Currently, accurately measuring the exact amount of sand entering the fuse and the amount of compactness of the sand is difficult.

SUMMARY

A need therefore exists for an improved high-voltage/current fuse for HEV systems. As described herein, various embodiments are directed to a fuse including a fuse body defining an inner cavity and having at least one fuse body aperture formed therethrough, a fuse element including a first terminal and a second terminal, a portion of the fuse element disposed within the inner cavity, the first terminal and the second terminal extending outside of the fuse body, a first endbell and a second endbell coupled to the fuse element, the first endbell having at least two grooves formed in a surface thereof and having a first O-ring seal disposed in at least one of the grooves, the second endbell having at least two grooves formed in a surface thereof and having a second O-ring seal disposed in at least one of the grooves, an adhesive securing each of the first endbell and the second endbell to the fuse body, an arc quenching material disposed within the inner cavity, the arc quenching material contacting at least a portion of the fuse element, and end caps coupled to the fuse body, the end caps sealing a portion of the fuse element within the fuse body.

Another embodiment of a fuse in accordance with the present disclosure may include a fuse element having a fuse body formed of metallic material including a first strip and a second strip arranged in one of a plurality of geometric configurations, the fuse body further including a set of electrically conductive bridges interconnecting adjacent portions of the first strip and the second strip, the set of electrically conductive bridges electrically connecting the first strip and the second strip, a first terminal and a second terminal coupled to the fuse element, a first endbell and a second endbell coupled to the fuse element, a hollow fuse tube having a first and second fuse body apertures formed therethrough, the hollow fuse tube housing a portion of the fuse element and the first and second endbells, the first endbell having a first groove formed in a surface thereof and having a first O-ring seal disposed in the first groove, the second endbell having a second groove formed in a surface thereof and having a second O-ring seal disposed in the second groove, the first and second grooves of the first and second endbells being aligned with the first and second fuse body apertures, respectively, an arc quenching material disposed between the first endbell and the second endbell within the hollow fuse tube, the arc quenching material surrounding at least a portion of the fuse element, wherein the arc quenching material occupies less than a total volume of the hollow fuse tube, and a first arc barrier disposed intermediate the first endbell and the arc quenching material and a second arc barrier disposed intermediate the second endbell and the arc quenching material.

A method manufacturing a fuse in accordance with the present disclosure may include providing a fuse element having a first end and a second end, a first terminal electrically connected to the first end and a second terminal electrically connected to the second end, coupling a first endbell to the first end of the fuse element and coupling a second endbell to the second end of the fuse element, the first endbell having at least two grooves formed in a surface thereof and having a first O-ring seal disposed in at least one of the grooves, the second endbell having at least two grooves formed in a surface thereof and having a second O-ring seal disposed in at least one of the grooves, inserting the fuse element into a hollow fuse having an inner cavity and at least two fuse body apertures formed therethrough, the first and second O-ring seals engaging an interior of the fuse body, filling the hollow fuse tube with an amount of arc quenching material, and fastening end caps onto ends of the hollow fuse tube.

BRIEF DESCRIPTION OF THE DRAWINGS

By way of example, specific embodiments of the disclosed device will now be described, with reference to the accompanying drawings, where.

DETAILED DESCRIPTION

Figure 1A:
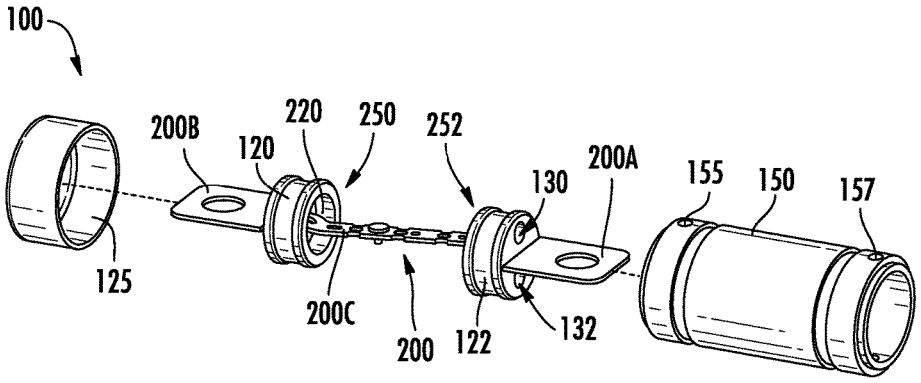
FIG. 1A is an exploded view of an HEV fuse in accordance with the present disclosure.

FIG. 1A is an exploded view of an HEV fuse 100 in accordance with the present disclosure. The HEV fuse 100 can include a fuse element 200 having a first conductive terminal 200A, a center element 200C, and a second conductive terminal 200B, a fuse body 150, fill apertures 155, 157, an end cap 125, endbells 250, 252, endbell holes 130, 132, outer grooves 120, 122, and a chamfer 220.

The fuse body 150 may be composed of a metallic material, and may be configured to receive at least a portion of the fuse element 200, the endbells 250, 252, and the end cap 125. FIG. 1A illustrates just one end cap (e.g., end cap 125), while in other embodiments the HEV fuse 100 includes end caps coupled to opposite ends. At least a portion of the fuse element 200 can be inserted into the fuse body 150. The first conductive terminal 200A and the second conductive terminal 200B can be comprised of silver, copper, tin, or nickel, or any combination thereof.

The fuse element 200 having the first conductive terminal 200A and the second conductive terminal 200B can electrically connect the HEV fuse 100 to a circuit to be protected and a power source.

The endbells 250, 252 can be configured to surround a defined portion of the fuse element 200. The endbells 250, 252 can provide a reservoir for holding a liquid or semi-liquid material, such as silicone, a room temperature vulcanized (RTV) material, gel, and/or any other arc quenching material. When the liquid or semi-liquid material is installed in the endbells 250, 252, the exact placement and volume of the liquid or semi-liquid material can be controlled to conform to the shape of the fuse element 200 as the liquid or semi-liquid material cures. The endbells 250, 252 can also improve consistency when filling the arc quenching material in the HEV fuse 100 by eliminating undercuts and air pockets inside the fuse body 150.

Figure 7:
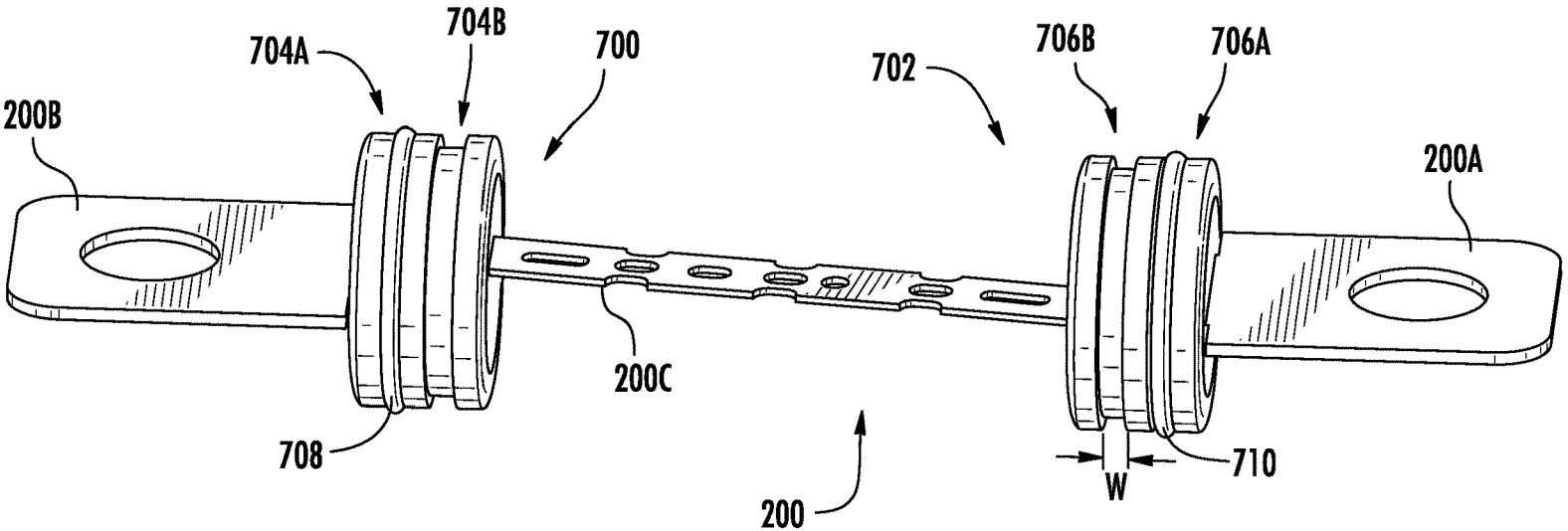
FIG. 7 is a perspective illustrating an alternative embodiment of an HEV fuse in accordance with the present disclosure.

The endbells 250, 252 can be cup-shaped and configured with one or more endbell holes, such as the endbell holes 130, 132 shown on endbell 252, through which holes the HEV fuse 100 may be filled with the arc quenching material, such as, for example, sand. (Endbell 250 may also include one or more holes.) The endbells 250, 252 may include the outer grooves 120, 122 on an outer circumference. The outer grooves 120, 122 can be aligned with the fill apertures 155, 157 respectively. The fill apertures 155, 157 can be used to fill the outer grooves 120, 122 with a liquid adhesive for securing the endbells 250, 252 to the fuse body. When the endbells 250, 252 can be secured together, the chamfer 220 (e.g., a chamfered joint) can be formed within the endbells 250, 252. An O-ring seal, for example, as shown in FIG. 7 and discussed in detail below, can be positioned in any of outer grooves 120, 122 to improve sealing the endbells 250, 252 to the fuse body 150. The liquid adhesive can be used to fill the remaining space around the O-ring in the outer grooves 120, 122.

Figure 1B:
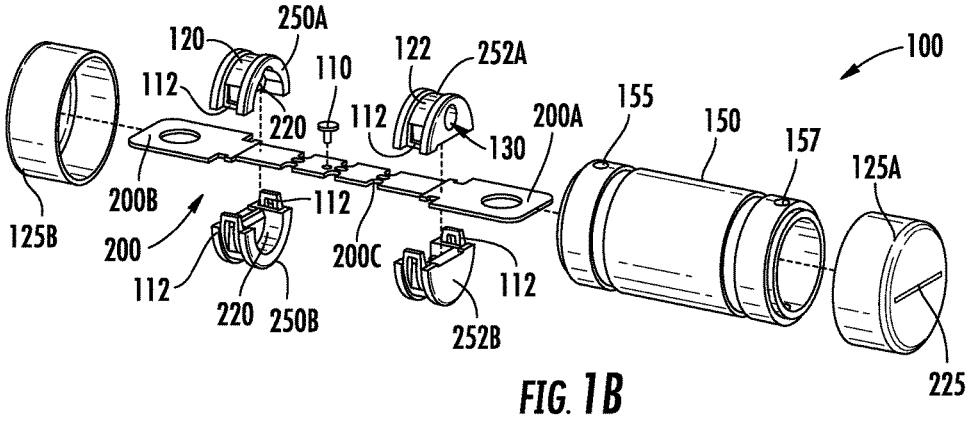
FIG. 1B provides further detail of the HEV fuse depicted in FIG. 1A.
Figure 1C:
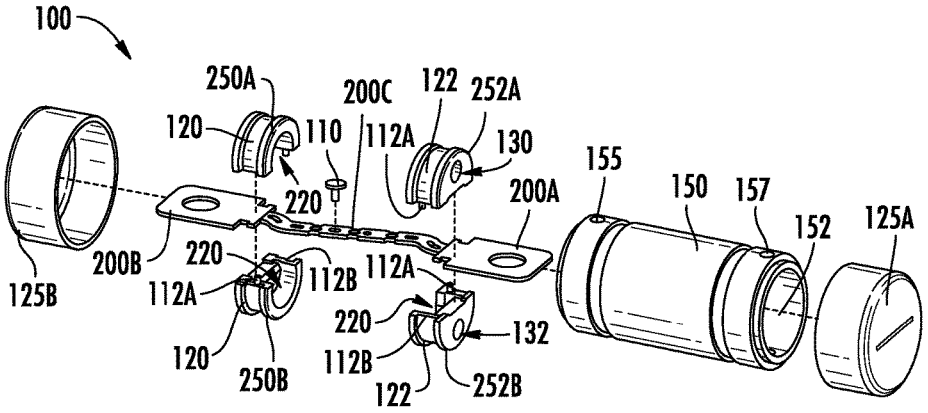
FIG. 1C is an exploded view of the HEV fuse depicted in FIG. 1A having an s-shaped fuse element.

FIG. 1B provides further detail of the HEV fuse 100 depicted in FIG. 1A. FIG. 1C is an exploded view of the HEV fuse 100 depicted in FIG. 1A having an s-shaped fuse element. Generally, the fuse element 200 of the HEV fuse 100 can be of any suitable size and shape. As an example, as illustrated in FIG. 1B, the fuse element 200 can be straight as shown by the center element 200C. As another example, as illustrated in FIG. 1C, the fuse element 200 can be s-shaped or oriented diagonally as shown by the center element 200C. The fuse element 200 may have a variety of geometric configurations, shapes, and lengths. As an example, the fuse element 200 can have an approximate length of 3.5 to four inches (e.g., approximately 8.9 cm to 10.2 cm).

In general, the fuse element 200 can be formed from or comprised of any material having desirable electrically conductive properties. In certain embodiments, the fuse element 200 can be nickel, copper, tin, or an alloy or mixture comprising nickel, copper, silver, gold, or tin, or any combination thereof. In certain embodiments, the fuse element 200 may have an approximate thickness of between 5 and 20 mils (a mil being a thousandth of an inch). A pellet 110 (e.g., a tin pellet) can be soldered to one or more positions on the fuse element 200.

In certain embodiments, the fuse body 150 is sized (e.g., by adjusting one or more of the length, width, height and thickness of the fuse body 150) so as to insulate a portion of the fuse element 200 (e.g., such as the center element 200C) while leaving portions of the fuse element 200 exposed for electrical connection (e.g., the first conductive terminal 200A and the second conductive terminal 200B) to an electrical system, such as an HEV system.

The endbells 250, 252, as more clearly illustrated in FIGS. 1B-1C, can be configured as a two-piece endbell assembly. In other words, the endbells 250, 252 can individually comprise a two-piece snap-together configuration. For example, the endbell 250 may include a first endbell section 250A and a second endbell section 250B. The first endbell section 250A can be attached to the second endbell section 250B via a connection 112. The endbell 252 may also include a first endbell section 252A and a second endbell section 252B. The first endbell section 252A can also be attached to the second endbell section 252B via a connection 112. The connection 112 can allow the first endbell section 250A to be snapped together to the second endbell section 250B, and the first endbell section 252A to be snapped together to the second endbell section 252B.

As clearly depicted in FIG. 1C, the connection 112 may include a latch 112A (or pin like device) and a latch receiver 112B, such as a latch-receiving bore, configured to receive and secure the latch 112A. The latch 112A can secure the first endbell section 250A to the second endbell section 250B in an assembled position with the latch 112A being secured to the latch receiver 112B. The latch 112A of the endbell 252 can also secure the first endbell section 252A to the second endbell section 252B in an assembled position.

The two-piece assembly of endbells 250, 252 can provide for the installation of the endbells 250, 252 while the fuse element 200 is still in a progressive die strip. By leaving the fuse element 200 attached to carrier strips when the fuse element 200 exits a progressive stamping die, the fuse element 200 can be supported on two sides. This reduces the possibility of damage from handling fragile individual elements in subsequent assembly processes.

In certain embodiments, an epoxy can be applied to the first endbell section 250A, the second endbell section 250B, the first endbell section 252A, and the second endbell section 252B. The epoxy can seal and secure the first endbell section 250A to the second endbell section 250B and can also seal and secure the first endbell section 252A to the second endbell section 252B. Accordingly, the endbells 250, 252 comprising the first endbell section 250A and the second endbell section 250B and the first endbell section 252A and the second endbell section 252B, respectively, can be epoxied together to form the cup-shaped endbells, that is, endbells 250, 252 around the fuse element 200 at or near the first conductive terminal 200A and around the fuse element 200 at or near a second conductive terminal 200B. The endbells 250, 252 can be configured with one or more endbell holes 130, 132, through which holes the fuse body 150 may filled with an arc quenching material.

The endbells 250, 252 can have a variety of shapes and sizes and can comprise a variety of materials. In certain embodiments, the endbells 250, 252 can be can comprise a high-temperature material, such as, for example, thermoset polyester. When installed on the fuse element 200, the endbells 250, 252 can support the fuse element 200 and ensure the fuse element 200 is centered in the fuse body 150. The endbells 250, 252 can ensure a consistent, flat surface on the outer ends, such as the first conductive terminal 200A and the second conductive terminal 200B of the HEV fuse 100 for end cap 125 installations.

As shown in FIG. 1C, an inner cavity 152 can be defined within the HEV fuse 100. The inner cavity 152 can receive the entirety of fuse element 200 or a portion of the fuse element 200 and endbells 250, 252. In an alternative embodiment, the first conductive terminal 200A and the second conductive terminal 200B of the fuse element 200 can extend beyond the inner cavity 152 (i.e., extend outside the fuse body).

The end caps 125A, 125B can be placed on opposite ends of the fuse body 150. The end caps 125A, 125B may also include an aperture, such as aperture 225 as more clearly illustrated on the end cap 125A, configured to allow the first conductive terminal 200A and the second conductive terminal 200B to pass there through. When the first conductive terminal 200A and the second conductive terminal 200B extend through apertures of the end caps 125A, 125B, respectively, the first conductive terminal 200A and the second conductive terminal 200B can be coupled to a circuit to be protected and also a power source. The end caps 125A, 125B may also be crimped.

Figure 1D:
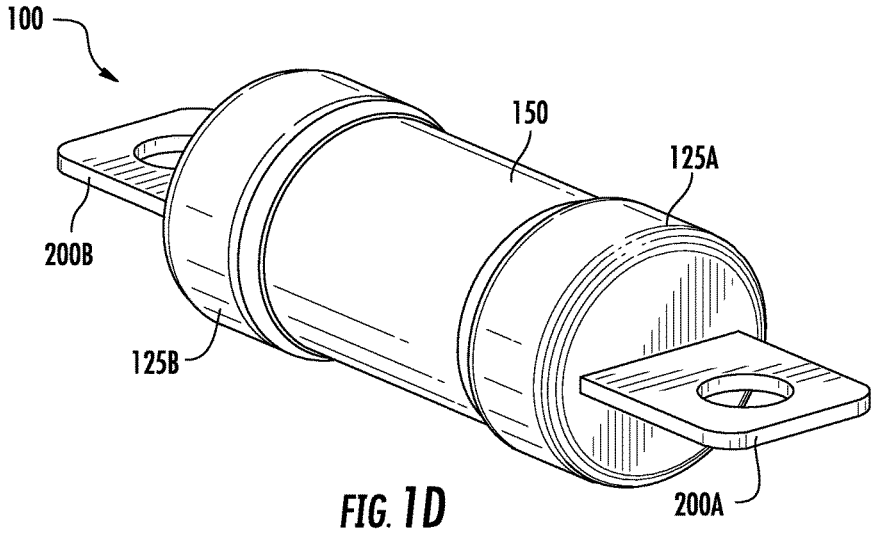
FIG. 1D is a perspective view of an assembled HEV fuse depicted in FIG. 1A.
Figure 1E:
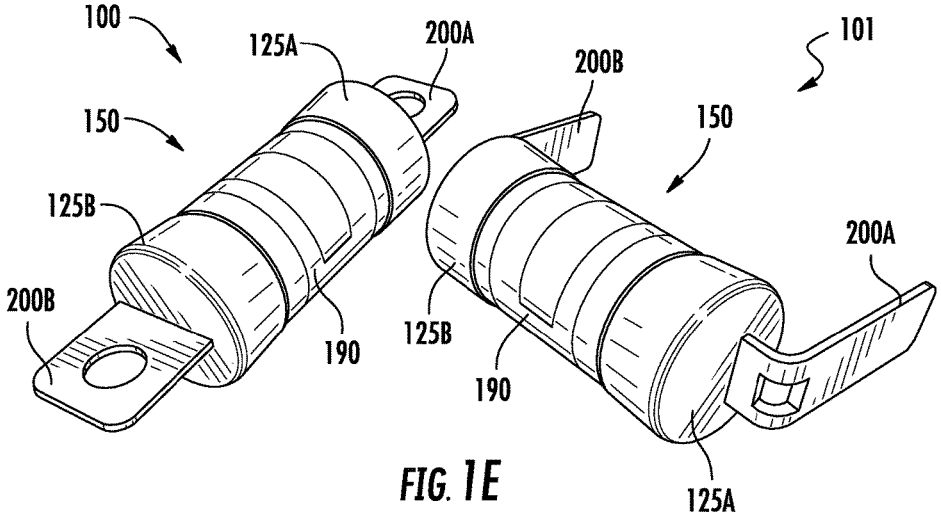
FIG. 1E provides an alternative perspective view of two assembled HEV fuses having labels.

FIG. 1D is a perspective view of an assembled HEV fuse 100. FIG. 1E provides an alternative perspective view of two assembled HEV fuses having labels. FIGS. 1D-1E more clearly illustrate fully assembled HEV fuse 100 and HEV fuse 101. The HEV fuse 101 may share the same components as HEV fuse 100, but for the terminals as discussed below. Specifically, the HEV fuse 100 and HEV fuse 101 as depicted in FIGS. 1D-1E can have the endbells 250, 252 attached to the fuse element 200. The endbells 250, 252 and fuse element 200 can all be inserted into the fuse body 150. Excess epoxy and/or silicone can be removed from the exterior of the HEV fuse 100 when accumulated as overflow while injecting liquid adhesive into the endbells 250, 252. This can provide a clean surface for crimping the end cap 125A and end cap 125B. The first and second ends, i.e., the conductive terminal 200A and conductive terminal 200B, can be straight and can extend through the fuse body 150, respectively.

As shown in FIG. 1D, in HEV fuse 100 the first conductive terminal 200A and the second conductive terminal 200B can remain in a straight position outside of the end caps 125A, 125B. Alternatively, as shown by the HEV fuse 101 in FIG. 1E, the first conductive terminal 200A and the second conductive terminal 200B can be bent so that their distal portions away from the fuse body 150 extend at an angle with respect to a long axis of the fuse body 150. Thus, in the different embodiments of FIG. 1E, the first conductive terminal 200A and second conductive terminal 200B may be adapted to engage a customer terminal or junction box in different ways. For the HEV fuse 100 the first conductive terminal 200A and second conductive terminal 200B are arranged in an industry-standard manner to serve as bolt-down terminals, meant for a customer to attach the HEV fuse 100 to a customer bolt-down terminal using a bolt and screw, for example. Regarding the HEV fuse 101, the first conductive terminal 200A and second conductive terminal 200B are bent so as to be able to engage a female terminal on a customer box. As further shown in FIG. 1E, a label 190 having identification and technical information can be applied to the HEV fuse 100 or HEV fuse 101. The label 190 may include other equivalent markings with manufacturer identification and technical information.

Figure 2A:
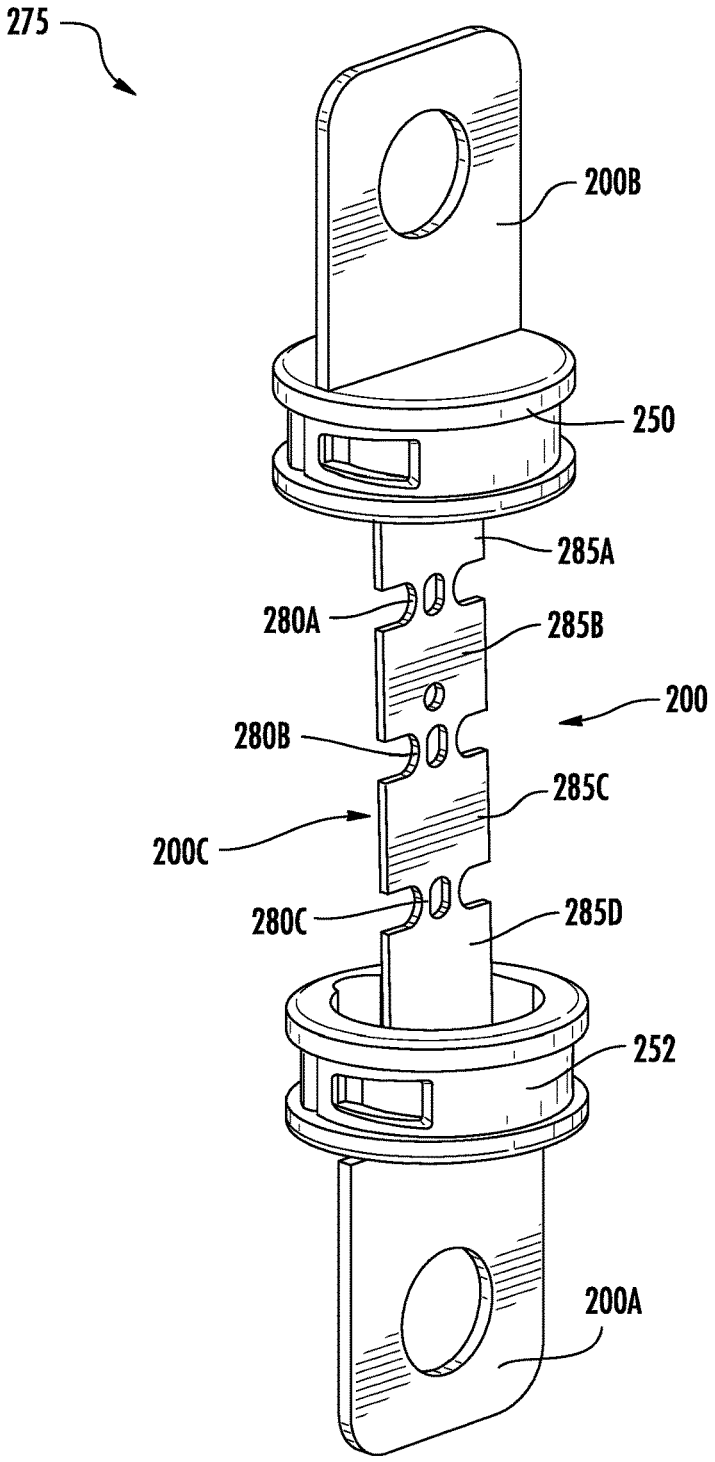
FIG. 2A illustrates an endbell assembly of the HEV fuse depicted in FIG. 1A.

FIG. 2A illustrates an endbell assembly 275 of the HEV fuse 100 depicted in FIG. 1A. The endbell assembly 275 can be used in the HEV fuse 100 depicted in FIGS. 1A-E. In FIG. 2A, the center element 200C is straight.

In certain embodiments, the endbell 252 can be positioned between the first conductive terminal 200A and the center element 200C of the fuse element 200. Further, the endbell 250 can be positioned between the center element 200C and the second conductive terminal 200B of the fuse element 200. The endbells 250, 252 assembled to the center element 200C can form the endbell assembly 275 (e.g., an endbell element assembly).

The center element 200C may also be configured with one or more bridges (illustrated as individual electrically conductive bridges 285A-285D) capable of being interconnected and/or coupled together by one or more electrically conductive element strips 280 (illustrated as individual conductive element strips 280A-280C). Collectively, the individual electrically conductive bridges 285A-285D and the individual electrically conductive element strips 280A-280C can form the center element 200C of the fuse element 200.

Figure 2B:
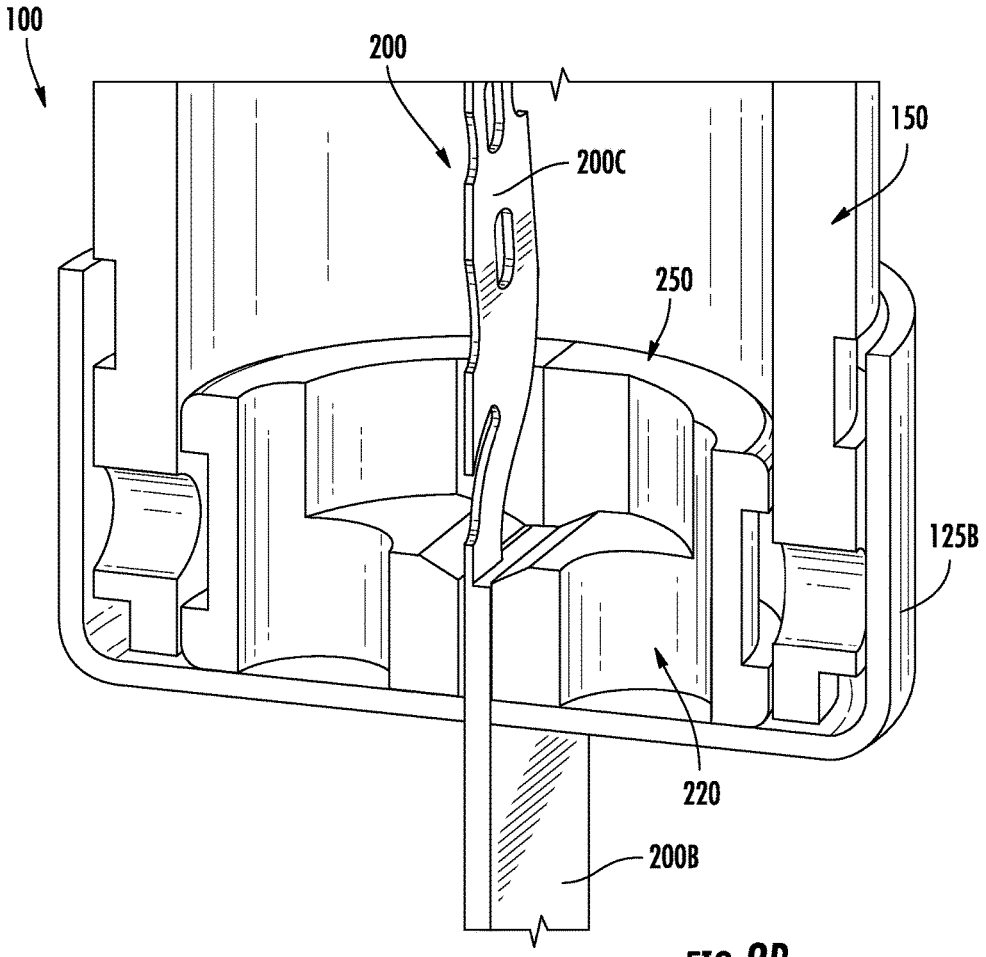
FIG. 2B provides a close-up cross-sectional view of the endbell assembly depicted in FIG. 2A.

FIG. 2B provides a close-up cross-sectional view of the endbell assembly 275 depicted in FIG. 2A housed in the fuse body 150. The following description related to the endbell 250 as shown in FIGS. 2B may also apply to the endbell 252. In certain embodiments, the cup-shaped example of endbell 250 shown in FIG. 2B can hold a liquid silicone arc suppressant, or a similar material having a high dielectric strength.

For example, the endbell 250 can be filled with silicone on sides of the fuse element 200 and can then be cured. As a result, an arc barrier can be formed according to the shape of the fuse element 200 and the internal assembly of the HEV fuse 100, thereby improving effectiveness over a pre-formed silicone arc barrier. Moreover, as illustrated in FIG. 2B, the chamfer 220 can be filled with epoxy designed to seal a first side and/or a second side of the HEV fuse 100. When pressure builds up inside of the fuse body 150, the seal created in the chamfer 220 can be of adequate strength to withstand the pressure. The epoxy within the chamfer 220 can completely surround the fuse element 200.

The HEV fuse 100 can be formed to create a three-zone fuse: two zones formed with silicone on opposite ends of the fuse element 200 (e.g., the two zones formed by placing silicone inside the endbells 250, 252) and a third zone in the center of the fuse element 200 surrounded by an arc quenching material (e.g., sand).

Figure 3:
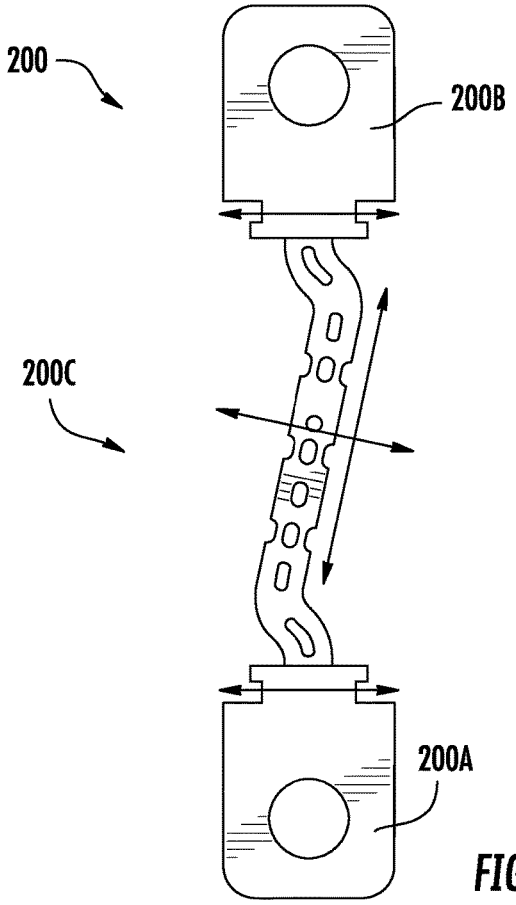
FIG. 3 illustrates a fuse element having an s-shape or a diagonal orientation with respect to the terminals on ends of the fuse element in accordance with the present disclosure.

FIG. 3 illustrates a fuse element 200 having an s-shape or a diagonal orientation with respect to the conductive terminal 200A and conductive terminal 200B on opposite ends of the fuse element 200 in accordance with the present disclosure. The fuse element 200 can be a one-piece copper element. The fuse element 200 may have a center element 200C oriented diagonally with respect to the conductive terminal 200A and conductive terminal 200B resulting in one of a variety of geometric configurations, such as a diagonal shape and/or a curved "S" shape. The diagonal orientation of the fuse element 200 enables an arc formed to be angled away from the terminals 200A.

The fuse element 200 of the HEV fuse 100 can be configured and designed to melt in the center element 200C. As an example, the fuse element 200 can melt within a diagonally oriented variant of center element 200C as shown in FIG. 3. After melting occurs in the center element 200C, a high-voltage arc can form. The center element 200C of the fuse element 200 orients the arc in certain directions (as illustrated by directional arrows in FIG. 3). The center element 200C can also provide strain relief during mechanical or thermal shock of the fuse element 200. The curved and/or angled shape of the center element 200C can provide for a higher breaking capacity of the fuse element 200 as compared to fuse element 200, the fuse element 200 being not partially curved and/or oriented diagonally with respect to the conductive terminal 200A and conductive terminal 200B.

Figure 4:
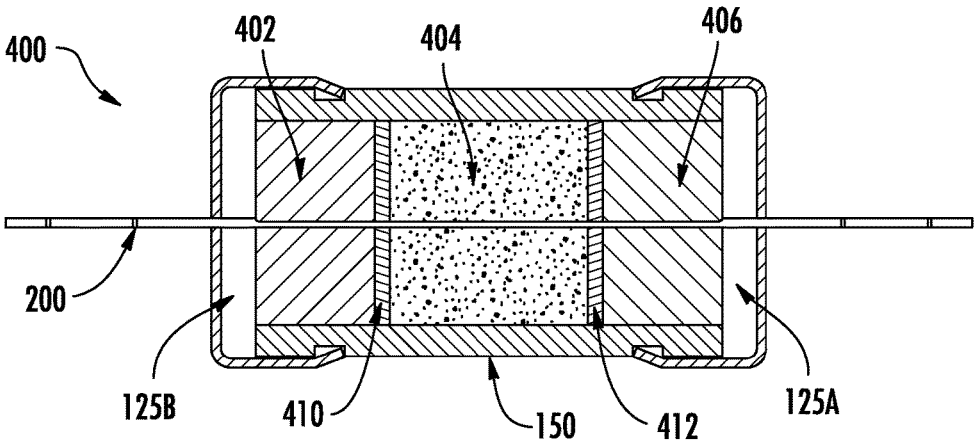
FIG. 4 is a cross-sectional view of a three-zone doped HEV fuse in accordance with the present disclosure.

FIG. 4 is a cross-sectional view of a three-zone doped HEV fuse 400 in accordance with the present disclosure. The following description related to the three-zone doped HEV fuse 400 may also apply to the HEV fuse 100.

The three-zone doped HEV fuse 400 includes the fuse element 200, the fuse body 150, the end caps 125A, 125B, and three distinct regions, such as a first outer region 402, a center region 404, and a second outer region 406, and barriers 410, 412. Optionally, a three-zone doped HEV fuse may be constructed that does not include the barriers 410, 412.

The fuse element 200 can electrically connect the three-zone doped HEV fuse 400 to a circuit to be protected and a power source. The fuse element 200 can be housed within the fuse body 150 and divided up into the first outer region 402, the center region 404, and the second outer region 406. The first outer region 402 and the second outer region 406 can surround the center region 404 on two opposite sides of the center region. In other words, the center region 404 can be defined between the first outer region 402 and the second outer region 406. Barrier 410 can separate and/or divide the center region 404 from the first outer region 402. Barrier 412 can separate and/or divide the center region 404 from the second outer region 406. The end caps 125A, 125B can be coupled to the fuse body 150. In other words, the end caps 125A, 125B can be positioned so as to seal off or cover the first outer region 402 and the second outer region 406.

The center region 404 can be filled with arc quenching material. The first outer region 402 and the second outer region 406 can also be filled with arc quenching material, while the first outer region 402 and the second outer region 406 can be additionally "doped" with a dielectric gel filling any interstitial gaps between the arc quenching material, such as the interstitial gaps between the grains of sand. In other words, the dielectric gel "doped" in the arc material in the first outer region 402 and the second outer region 406 can occupy space otherwise containing air, assisting to extinguish an electrical arc, such as an arc burning near end caps 125A, 125B of the three-zone doped HEV fuse 400. In one embodiment, the two outer regions (outer region 402 and outer region 406) can also include endbells 250, 252 as mentioned above in FIG. 1A.

The center region 404 can be limited to contain the arc quenching material. In other words, there is no dielectric gel inserted into the center region 404 to fill any interstitial gaps. This allows vaporized element materials to disperse throughout the center region 404 in response to the fuse element 200 opening near a center portion of three-zone doped HEV fuse 400.

The barriers 410, 412 can separate the center region 404 from the two outer regions (outer region 402 and outer region 406). The barriers 410, 412 can be installed to help contain the dielectric gel to desired regions, such as the first outer region 402 and the second outer region 406. The barriers 410, 412 can be created from a liquid adhesive, such as liquid silicone, to be later cured to a solid state.

As part of the manufacturing process to create the three-zone doped HEV fuse 400, the following example is provided merely for illustration purposes. The example is not to be limited and other processes may be defined. The fuse element 200 can be housed within the fuse body 150. One of the end caps, such as end cap 125A, can be coupled and/or assembled onto the fuse body 150. The second outer region 406 can be filled with the arc quenching material and also doped with the dielectric gel. Barrier 412 (e.g., a liquid adhesive) can be disposed over the arc quenching material and the dielectric gel in the second outer region 406 and cured to a solid state. The center region 404 can then be filled with the predetermined amount of arc quenching material. The fuse body 150 can be vibrated, shaken, and/or agitated to compact the predetermined amount of arc quenching material. Barrier 410 (e.g., a liquid adhesive) can be disposed over the arc quenching material in the center region 404 and cured to a solid state. The first outer region 402 can then be filled with the arc quenching material doped with the dielectric gel, and/or the liquid silicone. The end cap 125B can be coupled and/or assembled onto the fuse body 150.

Figure 5:
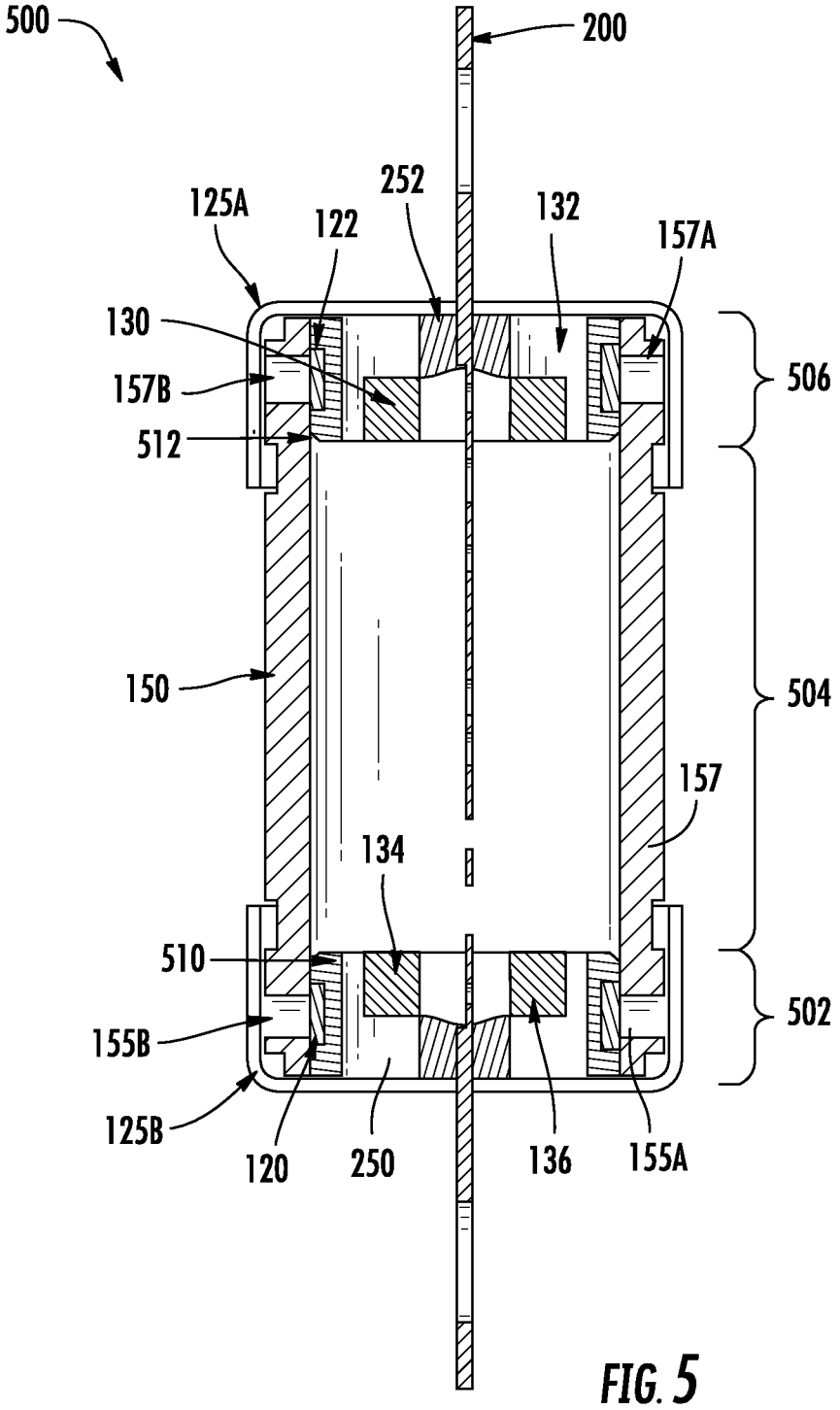
FIG. 5 is a cross-sectional view of a three-zone doped HEV fuse for an arc quenching material filling and topping process in accordance with the present disclosure.

FIG. 5 is a cross-sectional view of a three-zone doped HEV fuse 500 for an arc quenching material filling and topping process in accordance with the present disclosure. The following description related to the three-zone doped HEV fuse 500 may also apply to the three-zone doped HEV fuse 400 and to the HEV fuse 100.

The three-zone doped HEV fuse 500 includes the fuse element 200, the fuse body 150, the end caps 125A, 125B, and three distinct regions, such as a first outer region 502, a center region 504, and a second outer region 506, barriers 510, 512, endbells 250, 252, endbell holes 130, 132, 134, 136, outer grooves 120, 122, and fill apertures 155A-155B, 157A-157B.

The fuse element 200 can electrically connect the three-zone doped HEV fuse 500 to a circuit to be protected and to a power source. The fuse element 200 can be housed within the fuse body 150 and divided up into the first outer region 502, the center region 504, and the second outer region 506. More specifically, the first outer region 502 and the second outer region 506 can surround the center region 504 on two opposite sides. In other words, the center region 504 can be defined between the first outer region 502 and the second outer region 506.

The endbells 250, 252 may be coupled to the fuse element 200. More specifically, the first outer region 502 and the second outer region 506 can be created by the endbells 250, 252. The endbells 250, 252 can define the area of the first outer region 502 and the second outer region 506 when the fuse element 200 is assembled within the fuse body 150. Barrier 510 can separate and/or divide the center region 504 from the first outer region 502. Barrier 512 can separate and/or divide the center region 504 from the second outer region 506. The endbell 252 can include endbell holes 130, 132, and outer groove 120. The endbell 250 can include endbell holes 134, 136, and outer groove 122.

The endbell holes 130, 132, 134, and 136 can be configured for allowing and/or assisting a liquid silicone, arc quenching material, and/or adhesive substance to be injected into the first outer region 502, the center region 504, and/or the second outer region 506. In other words, endbell holes 130, 132, 134, and 136 can be configured for allowing and/or assisting a liquid silicone, arc quenching material, and/or adhesive substance to be injected prior to and/or during assembly of the fuse element 200 into the fuse body 150. For example, endbell holes 130, 132, 134, and 136 can be configured for filling the fuse body 150 with the arc quenching material.

The outer grooves 120, 122, located on the endbells 250, 252 respectively, can be aligned with the fill apertures 155A-155B, 157A-157B located at one of a variety of positions on the fuse body 150. The fill apertures 155A-155B, 157A-157B can be configured for allowing and/or assisting a liquid silicone, arc quenching material, and/or adhesive substance to be injected prior to and/or during assembly of the fuse element 200 into the fuse body 150. In other words, fill apertures 155A-155B, 157A-157B can be configured for filling the fuse body 150 with the arc quenching material or filling the outer grooves 120, 122 with a liquid adhesive to secure the endbells 250, 252 to the fuse body 150.

The end caps 125A, 125B can be coupled to the fuse body 150. In other words, the end caps 125A, 125B can be positioned so as to seal off and/or cover the endbells 250, 252 (e.g., seal off and/or cover first outer region 502 and the second outer region 506.)

As part of the manufacturing process to create the three-zone doped HEV fuse 500, the following example is provided merely for illustration purposes. The example is not to be limited and other processes may be defined.

First, the endbell 250 can be coupled on the fuse element 200 at one of variety of positions, such as near a bottom side. In other words, the endbell 250 can be coupled to the fuse element 200 by a latching system (e.g., a latching pin and receiving bore). The endbell 250 can be filled with an arc quenching material and doped with a dielectric gel and/or filled with a liquid silicone prior to the fuse element 200 and the endbell 250 being assembled into the fuse body 150. The liquid silicone can create barrier 510. In one embodiment, when the silicone is first injected into endbell 250, the silicon may be injected into endbell hole 134 and flow out of endbell hole 136 indicating any open space of endbell 250 has been filled with the liquid silicon.

The endbell 252 can be coupled on the fuse element 200 at one of variety of positions, such as near a top side. In other words, the endbell 252 can be coupled to the fuse element 200 by a latching system (e.g., a latching pin and receiving bore). Once the endbells 250, 252 are coupled to the fuse element 200, the fuse element 200 can be housed within the fuse body 150.

In some embodiments, the endbells 250, 252 can be coupled to the fuse element 200 and can be filled with an arc quenching material and doped with a dielectric gel and/or filled with a liquid silicone prior to being assembled into the fuse body 150 with the fuse element 200. Alternatively, either the endbell 250 or the endbell 252, after the two have been coupled to the fuse element 200, can be filled with an arc quenching material and doped with a dielectric gel and/or filled with a liquid silicone prior to being assembled into the fuse body 150 with the fuse element 200. As such, barriers 510, 512 may be created at a later time in the assembly of the three-zone doped HEV fuse 500. For example, the arc quenching material and doped with a dielectric gel and/or a liquid silicone may be injected into the endbell 252 after the arc quenching material is injected and fills the center region 504, as described below.

The fuse element 200 and the endbells 250, 252 can be housed within the fuse body 150. The fuse element and the endbells 250, 252 housed in the fuse body 150 define the first outer region 502, the center region 504, and the second outer region 506. In other words, the endbell 250 can be defined as the second outer region 506, and the endbell 252 can be defined as the first outer region 502. The center region 504 can be defined as the area between the first outer region 502 and the second outer region 506.

At this point the outer grooves 120, 122, located on the endbells 250, 252 respectively, can be filled with a liquid adhesive. The liquid adhesive can be injected into the fill apertures 155A-155B, 157A-157B. The liquid adhesive can flow around the entirety of the outer grooves 120, 122 and cure to a solid state. The endbells 250, 252 can be sealed to the fuse body in a fixed position by the cured liquid adhesive. The end cap 125A and/or end cap 125B can be coupled to opposite ends of the fuse body, sealing off the first outer region 502 and the second outer region 506.

Next, a measured quantity of the arc quenching material can be poured through an open end of the one or more endbell holes 130, 132, 134, and/or 136 into the fuse body 150. The measured quantity of the arc quenching material may fill the entirety of center region 504 or a portion of the center region 504. For example, a measured quantity of the arc quenching material can be poured through endbell hole 130 as well as endbell hole 134 to fill the center region 504. Alternatively, if barrier 510 was previously created and sealing off endbell holes 134, and/or 136, the measured quantity of the arc quenching material can be poured through endbell holes 130, 132 to fill the center region 504.

The fuse body 150 can be vibrated, tapped, and/or agitated to increase the compaction of the arc quenching material inside the fuse body 150. The measured quantity of the arc quenching material fills the center region beginning from barrier 510 up to the endbell 252 (e.g., the second outer region 506). In other words, the measured quantity of the arc quenching material can be less than the total volume of the fuse body 150. The measured amount of arc quenching material quantity can allow for a specific amount of open space in the second outer region 506.

Once the measured amount of arc quenching material is compacted within the center region 504, the barrier 512 can be created. Barrier 512 can be created by injecting the liquid silicone into one or more endbell holes 130, 132, and subsequently curing the liquid silicone to a solid state. In other words, liquid silicone is injected through one or more endbell holes 130, 132 at the top section of the endbell 252 so as to fill the remaining, open volume of air and/or space within the endbell 252 above the arc quenching material in the center region 504. In one embodiment, when the liquid silicone is injected into endbell 252, the liquid silicone can be injected into endbell hole 130 and flow out of endbell hole 132 indicating any open space of endbell 252 has been filled with the liquid silicon. The liquid silicone can "bleed" into a portion of the arc quenching material in the center region 504 during curing and create a silicone-sand interface more precisely defining barrier 512. The bleeding helps the silicone cure consistently and prevents the formation of air bubbles at the silicone-sand interface created between the second outer region 506 and the center region 504.

The bleeding of the liquid silicone can also apply to the creation of barrier 510. In other words, the liquid silicone can bleed into a portion of the arc quenching material in the center region 504 during curing and create a silicone-sand interface more precisely defining barrier 510. The bleeding of the liquid silicone into a portion of the arc quenching material in the center region helps the silicone cure consistently and prevents the formation of air bubbles at a silicone-sand interface created between the first outer region 502 and the center region 504 and/or the second outer region 506 and the center region 504. In short, at least a portion of barriers 510, 512 shields the arc quenching material in the center region 504 from the first outer region 502 and from the second outer region 506. An arc quenching material doped with a dielectric gel can be injected into the endbells 250, 252. In other words, the arc quenching material doped with a dielectric gel can form at least a portion of the barriers 510, 512.

The amount of silicone viscosity in the first outer region 502 as well as the second outer region 506 can be predetermined, tested, and/or selected so as to control the depth of the barriers 510, 512. Thus, controlling the depth of the barriers 510, 512 by the predetermined, tested, and/or selected amount of liquid silicone, allows the liquid silicone to cure and solidify while not into the arc quenching material in the center region 504 too quickly, thus preventing any air pocket forming in either the first outer region 502 and/or the second outer region 506.

In this way, the various embodiments eliminate the process of filling the arc quenching material in an enclosed space with tightly-packed sand. The various embodiments allow a measured quantity of arc quenching material to be used to fill the inner cavity of the fuse body (e.g., the center region 504) and allow the liquid silicone in the first outer region 502 and the second outer region 506 to absorb any variations in sand quantity or compaction.

Figure 6:
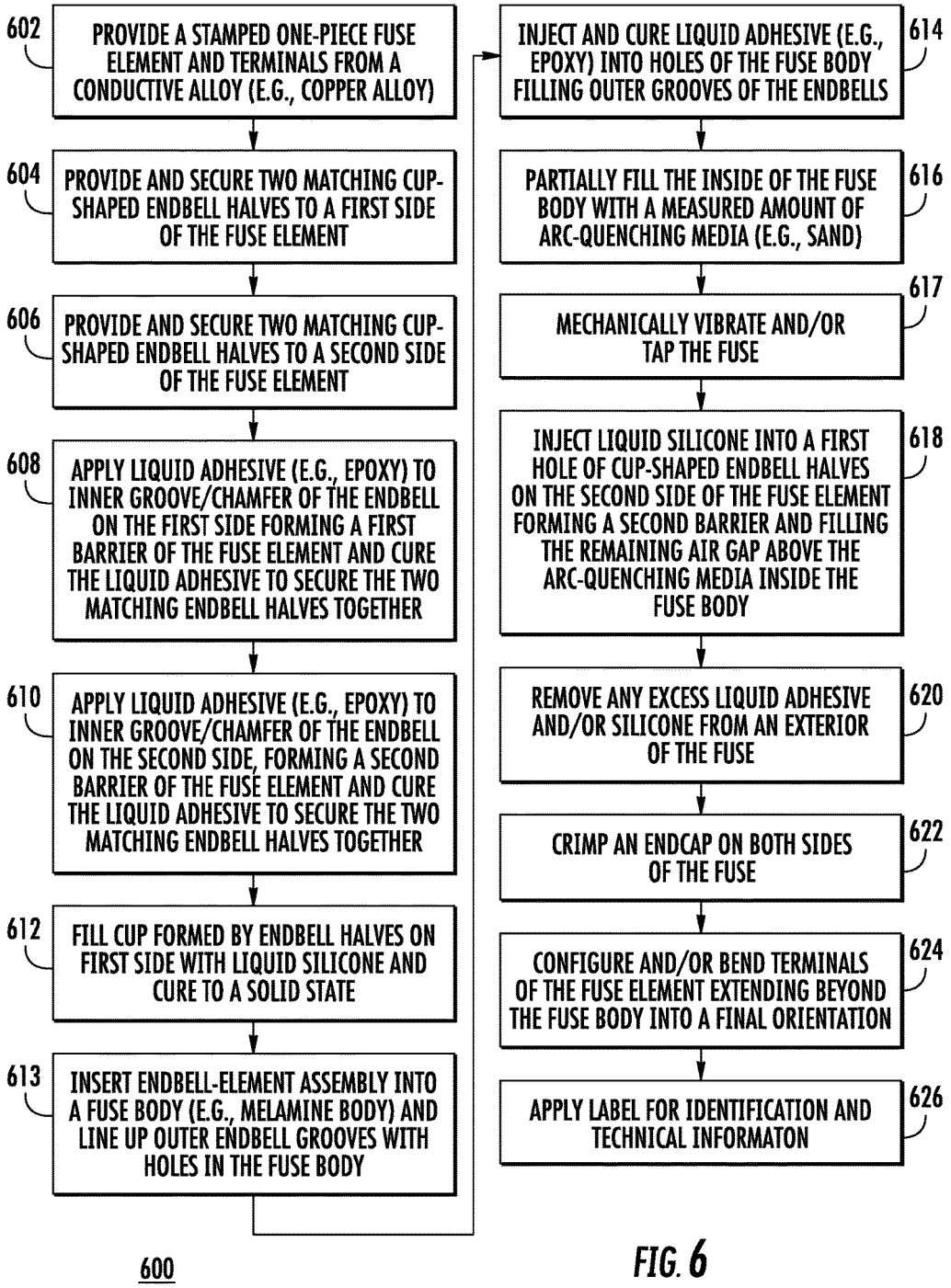
FIG. 6 is a flow diagram of a method for manufacturing an HEV fuse according to the present disclosure.

FIG. 6 is a flow diagram of a method 600 for manufacturing an HEV fuse according to the present disclosure. The method 600 can be used to manufacture the HEV fuse 100, the three zone doped HEV fuse 400, and/or the three-zone doped HEV fuse 500. At block 602, a stamped one-piece fuse element having terminals is provided from a copper alloy (or similar material). At block 604, two matching cup-shaped endbell halves are provided and secured to a first side of the fuse element. The endbell halves on the first side can be solid, having no endbell holes, or may include one or more endbell holes. At block 606, two matching cup-shaped endbell halves are provided and secured to a second side of the fuse element. The endbell halves on the second side of the fuse element can have one or more holes defined therein. At block 608, a liquid adhesive (e.g., an epoxy) can be applied to an inner groove and/or chamfer of the endbell on the first side of the fuse element and the epoxy can be cured so as to secure the endbell halves together. An arc quenching material doped with dielectric gel, along with the liquid silicone, may be injected into to the endbells haves when coupled together. At block 610 a liquid adhesive (e.g., epoxy) is applied to inner grove/chamfer of the endbell on the second side, forming a second barrier of the fuse element, and the liquid adhesive is cured to secure the two matching endbell halves together. At block 612, a cup formed by endbell halves on a first side is filled with liquid silicone and cured to a solid state.

At block 613, the fuse element can be inserted into a fuse body (e.g., a melamine body) and outer endbell grooves on the two endbells can be aligned with fill apertures on the fuse body. As described in more detail below with respect to FIG. 7, an O-ring seal can be positioned in the grooves of the endbell prior to insertion into the fuse body. The fuse element inserted into the fuse body can form three distinct regions, such as a first outer region defined as the region where the endbell is secured to the first side of the fuse element, a center region that can be empty and/or hollow, and a second outer region defined as the region where the endbell is secured to the second side of the fuse element. At block 614, a liquid adhesive such as epoxy is injected into holes of the fuse body, filling outer grooves of the endbells.

At block 616, an inside portion of the fuse body can be filled (e.g., partially filled) with a measured amount of arc quenching material (e.g., sand) through holes in the endbell secured to the second side of the fuse element. The amount of arc quenching material (e.g., sand) can fill starting from the endbell secured to the first side of the fuse element (e.g., the first outer region) up to a level approximately even with the bottom of the endbell on the second side (e.g., the second outer region) of the fuse element leaving an air gap inside the top of the HEV fuse (e.g., the second outer region yet to be filled). In other words, the amount of arc quenching material (e.g., sand) can be deposited within the center region between two endbells secured to the fuse element.

At block 617, the fuse body can be mechanically vibrated and/or tapped to compact the arc quenching material (e.g., sand) inside the fuse body. At block 618, liquid silicone can be injected into a first hole of the endbell on the second side of the fuse element filling the remaining air gap inside the fuse body (above the sand). In one embodiment, an arc quenching material doped with dielectric gel, along with the liquid silicone, may be injected into to the endbell on the second side of the fuse element. The liquid silicone (and/or the arc quenching material doped with dielectric gel and/or the liquid silicone) can flow from the first hole and out of a second hole in the endbell on the second side of the fuse element to indicate any remaining air gaps are now filled in the endbell on the second side. In other words, the liquid silicone and the endbell on the second side of the fuse element form a second barrier (e.g., silicon-sand interface) to protect and seal off the center region having the arc quenching material from the second outer region. Also, the liquid silicone injected (as in step 610) in the endbell of the first side also forms a first barrier (e.g., silicon-sand interface) to protect and seal off the center region having the arc quenching material from the first outer region. The silicone is cured to a solid state locking the contents of the fuse body securely in place.

At block 620, any excess silicone (e.g., epoxy) can be removed from the exterior of the fuse body when accumulated during the filling processes. This provides a clean surface for crimping. At block 622, end caps (e.g., stainless steel end caps) can be crimped on opposite sides of the fuse for additional mechanical strength and to ensure any holes on opposite sides of the fuse element are completely sealed. At block 624, the terminals of the fuse element can be configured and/or bent into a final orientation. The end caps may include apertures configured for the terminals on the fuse element to extend through the aperture of a given terminal. At block 626, a label having identification and technical information can be applied to the fuse body. The label may include other equivalent markings with manufacturer identification and technical information. In various embodiments, the label may be generated by lasermarking, pad printing or hot stamping in the place of an actual printed paper-type label. The embodiments are not limited in this context.

As such, the method of manufacturing provides the HEV fuse 100, the three zone doped HEV fuse 400, and/or the three-zone doped HEV fuse 500. One or more of the HEV fuse 100, the HEV fuse 101, the three zone doped HEV fuse 400, and/or the three-zone doped HEV fuse 500 may comprise a fuse body 150 having an inner cavity (or center region 504) and at least one fuse body aperture (e.g., fill apertures 155A-155B, 157A-157B). The fuse element 200 may comprise a terminal on opposite ends of the fuse element 200 (e.g., a first terminal and a second terminal). The fuse element 200 can be disposed within fuse body. Two ends of the fuse element defined as the terminals (e.g., the first terminal and the second terminal) can electrically connect the HEV fuse 100, the three zone doped HEV fuse 400, and/or the three-zone doped HEV fuse 500 to a circuit to be protected and a power source. A first endbell and a second endbell can be coupled to the fuse element. An arc quenching material can be disposed within the inner cavity. The arc quenching material can make contact with at least a portion of the fuse element 200. A liquid adhesive can fill the first endbell and the second endbell to seal the arc quenching material between the first endbell and the second endbell inside the fuse body.

Referring to FIG. 7, an alternative embodiment of the above-described endbells 250, 252 depicted in FIGS. 1A-1C is illustrated. As shown, the alternative endbells 700, 702 may be substituted for the endbells 250, 252 and may be implemented in conjunction with the fuse element 200 in a manner substantially similar to the endbells 250, 252. The endbells 700, 702 may each include at least two annular grooves 704A, 704B, and 706A, 706B formed in their respective outer surfaces. The grooves 704A, 704B, and 706A, 706B may be of equal size and/or shape, having the same width w and depth, but this is not critical. In other embodiments, the grooves 704A, 704B, and 706A, 706B may have different sizes and/or shapes with different widths and/or depths. The grooves 704B and 706B may be positioned inward of (i.e., nearer the center along the longitudinal axis of the fuse element 200 relative to) the grooves 704A and 706A. The grooves 704B and 706B may therefore be referred to as the "innermost" grooves 704B, 706B, and the grooves 704A and 706A may be referred to as the "outermost" grooves 704A, 706A.

O-ring seals 708, 710 may be disposed within the outermost grooves 704A, 706A, respectively, though it is contemplated that one or more O-ring seals may be disposed in any of the grooves 704A, 704B, 706A, 706B. For example, O-ring seals may additionally or alternatively be disposed in the innermost grooves 704B, 706B. The O-ring seals 708, 710 may be formed of a flexible, resilient material (e.g., rubber, plastic, various composite materials, etc.), and may be sized to substantially fill their respective outermost grooves 704A, 706A. The O-ring seals 708, 710 may radially protrude from their respective outermost grooves 704A, 706A to facilitate engagement with an interior surface of the fuse body 150 (FIGS. 1A-1C) when the HEV fuse 100 is assembled as further described below.

During assembly of the HEV fuse 100 (FIGS. 1A-1C), the fuse element 200 and the endbells 700, 702 may be inserted into the fuse body 150, and the empty, innermost grooves 704B, 706B (i.e., the grooves that do not have O-ring seals seated within them) may subsequently be filled with a liquid adhesive via the fill apertures 155, 157 in the fuse body 150, the fill apertures 155, 157 being substantially aligned with the innermost grooves 704B, 706B when the fuse element 200 and the endbells 700, 702 are disposed within the fuse body 150. As described above in relation to FIGS. 1A-1C, the fill apertures 155A-155B, 157A-157B may be configured to allow a liquid adhesive, such as liquid silicone, an arc quenching adhesive material, and/or various other adhesive substances to be injected into the empty, innermost grooves 704B, 706B. In various embodiments, it is contemplated that the liquid adhesive may additionally be injected into grooves having O-ring seals disposed within them (e.g., the outermost grooves 704A, 706A), and that the liquid adhesive may flow around such O-ring seals in unoccupied areas to provide additional sealing.

Thus, the O-ring seals 708, 710 may provide additional sealing between the endbells 700, 702 and the fuse body 150 (i.e., in addition to the seals provided by the liquid adhesive introduced via the fill apertures 155, 157 of the fuse body 150 as described above). Particularly, double seals are formed at the longitudinal ends of the fuse body 150 by the sealing of the O-ring seals and the adhesive sealing between the fuse body 150 and each of the endbells 700, 702. When gas pressure builds within the fuse body 150 after melting of the fuse element 200, this "double seal" arrangement may provide adequate strength to withstand the gas pressure and prevent the gases from escaping the fuse body 150. Particularly, the double seal arrangement achieved by implementing the O-ring seals 708, 710, along with the seals provided by the liquid adhesive, is able to withstand much greater gas pressure buildup within the fuse body 150 before rupturing relative to using the liquid adhesive seals alone.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize its usefulness is not limited thereto and the present disclosure can be beneficially implemented in any number of environments for any number of purposes. Thus, the claims set forth below are to be construed in view of the full breadth and spirit of the present disclosure as described herein.

The invention claimed is:

1. A fuse, comprising:

a fuse body defining an inner cavity and having at least one fuse body aperture formed therethrough;

a fuse element including a first terminal and a second terminal, a portion of the fuse element disposed within the inner cavity, the first terminal and the second terminal extending outside of the fuse body;

a first endbell coupled to the fuse element, the first endbell having at least two grooves formed in a surface thereof and having a first O-ring seal disposed in one of the at least two grooves, and adhesive securing the first endbell to the fuse body disposed in the other of the at least two grooves, such that a first double seal is formed between the fuse body and the first endbell by the first O-ring seal and the adhesive;

a second endbell coupled to the fuse element, the second endbell having at least two grooves formed in a surface thereof and having a second O-ring seal disposed in one of the at least two grooves, and adhesive securing the second endbell to the fuse body disposed in the other of the at least two grooves, such that a second double seal is formed between the fuse body and second endbell by the second O-ring seal and the adhesive;

an arc quenching material disposed within the inner cavity, the arc quenching material contacting at least a portion of the fuse element; and end caps coupled to the fuse body, the end caps sealing a portion of the fuse element within the fuse body;

wherein the first endbell and the second endbell are cup-shaped such that a first chamfer is formed within the first endbell and a second chamfer is formed within the second endbell.

2. The fuse of claim 1, wherein the first and second O-ring seals engage an interior of the fuse body and provide seals intermediate the first and second endbells and the fuse body.

3. The fuse of claim 1, wherein the at least two grooves in the first endbell include an innermost groove and an outermost groove, the innermost groove being located nearer a longitudinal center of the fuse body relative to the outermost groove, wherein the at least two grooves in the second endbell include an innermost groove and an outermost groove, the innermost groove being located nearer a longitudinal center of the fuse body relative to the outermost groove, and wherein the first and second O-ring seals are disposed within the outermost grooves of the first and second endbells.

4. The fuse of claim 1, further comprising a first arc barrier disposed intermediate the first endbell and the arc quenching material and a second arc barrier disposed intermediate the second endbell and the arc quenching material.

5. The fuse of claim 1, wherein the first endbell is coupled to the first terminal and the second endbell is coupled to the second terminal.

6. The fuse of claim 1, wherein the first endbell and the second endbell each include a first endbell section and a second endbell section.

7. The fuse of claim 1, wherein the fuse element and the first endbell and the second endbell within the fuse body form a three-zone fuse, a first zone including at least a liquid adhesive, a second zone including at least the arc quenching material, and a third zone including at least the liquid adhesive, the second zone is between the first zone and the third zone.

8. The fuse of claim 7, wherein the first endbell is positioned in the first zone, the second endbell is positioned in the third zone, and a center element of the fuse element is positioned in the second zone, the fuse element traversing through the first zone, the second zone, and the third zone.

9. A fuse comprising:

a fuse element including a center element formed of metallic material and having a first strip and a second strip arranged in a geometric configuration, the center element further including an electrically conductive bridge interconnecting adjacent portions of the first strip and the second strip, the electrically conductive bridge electrically connecting the first strip and the second strip;

a first terminal and a second terminal coupled to the fuse element;

a first endbell and a second endbell coupled to the fuse element;

a hollow fuse tube having a first and second apertures formed therethrough, the hollow fuse tube housing a portion of the fuse element and the first and second endbells, the first endbell having a first groove formed in a surface thereof and having a first O-ring seal disposed in the first groove, the second endbell having a second groove formed in a surface thereof and having a second O-ring seal disposed in the second groove, the first and second grooves of the first and second endbells being aligned with the first and second apertures, respectively;

an arc quenching material disposed between the first endbell and the second endbell within the hollow fuse tube, the arc quenching material surrounding at least a portion of the fuse element, wherein the arc quenching material occupies less than a total volume of the hollow fuse tube; and a first arc barrier disposed intermediate the first endbell and the arc quenching material and a second arc barrier disposed intermediate the second endbell and the arc quenching material;

wherein the first endbell and the second endbell are cup-shaped such that a first chamfer is formed within the first endbell and a second chamfer is formed within the second endbell.

10. The fuse of claim 9, wherein the first endbell and the second endbell each include a first endbell section and a second endbell section that are coupled together.

11. The fuse of claim 9, wherein:

the first endbell further includes a third groove disposed inward from the first groove along a longitudinal axis of the hollow fuse tube; and the second endbell further includes a fourth groove disposed inward from the second groove along the longitudinal axis of the hollow fuse tube.

12. The fuse of claim 11, wherein a third O-ring seal is disposed in the third groove on the first endbell, and a fourth O-ring seal is disposed in the fourth groove on the second endbell.

* * * * *